US009646518B2

(12) United States Patent
Wollard

(10) Patent No.: US 9,646,518 B2
(45) Date of Patent: May 9, 2017

(54) METHOD AND APPARATUS FOR INDICATING CONDITIONS

(71) Applicant: Bartco Traffic Equipment Pty Ltd., Port Melbourne (AU)

(72) Inventor: Troy Raymond Wollard, Port Melbourne (AU)

(73) Assignee: Bartco Traffic Equipment Pty Ltd., Port Melbourne (AU)

( * ) Notice: Subject to any disclaimer, the term of this patent is extended or adjusted under 35 U.S.C. 154(b) by 977 days.

(21) Appl. No.: 13/896,352

(22) Filed: May 17, 2013

(65) Prior Publication Data

US 2014/0343854 A1 Nov. 20, 2014

(51) Int. Cl.

| | |
|---|---|
| ***G09F 13/04*** | (2006.01) |
| ***G09F 13/00*** | (2006.01) |
| ***G09F 27/00*** | (2006.01) |

(52) U.S. Cl.

CPC ..... *G09F 13/005* (2013.01); *G09F 13/04* (2013.01); *G09F 27/00* (2013.01); *G09F 2013/0431* (2013.01); *G09F 2013/0459* (2013.01)

(58) Field of Classification Search

CPC ..... G09F 13/04
USPC ..... 702/3
See application file for complete search history.

(56) References Cited

U.S. PATENT DOCUMENTS

2014/0290103 A1* 10/2014 Kyberd ..... G08B 5/28 40/466

OTHER PUBLICATIONS

Australian County Fire Authority, "Automated Fire Danger Rating Sign", Request to provide a proposal dated Sep. 16, 2011, pp. 1-2.
Bartco, "Expression of Interest", County Fire Authority, Dated Oct. 5, 2011, pp. 1-10.

* cited by examiner

*Primary Examiner* — Bryan Bui
(74) *Attorney, Agent, or Firm* — Eversheds Sutherland (US) LLP

(57) ABSTRACT

The present invention relates to the field of display and monitoring of environmental conditions. In one form, the invention provides a public warning system for conveying status of a condition at several discrete locations. The system may include a number of signs each being automated for indicating environmental conditions including a segmented conditions rating scale physically disposed on a substrate for public display wherein an illuminated display panel is operatively associated with each segment of the segmented conditions rating scale and each sign having a wireless communication device and being located at one of the discrete locations. The system further may include a central control that remotely corresponds with the signs using a wireless network and the wireless communication devices of the signs, such that the signs can independently and/or collectively be directed by the central control to alter the status level of the condition.

23 Claims, 10 Drawing Sheets

METHOD AND APPARATUS FOR INDICATING CONDITIONS

FIELD OF INVENTION

The present invention relates to the field of display and monitoring of environmental conditions. In particular, preferred embodiments of the present invention relate to the display of information in relation to warnings in at least one locality. It will be convenient to hereinafter describe the invention in relation to a remotely controlled and monitored network of signs used for informing the public of fire conditions and coordinating fire fighting efforts, however, it should be appreciated that the present invention is not limited to that use, only.

BACKGROUND ART

Throughout this specification the use of the word "inventor" in singular form may be taken as reference to one (singular) inventor or more than one (plural) inventor of the present invention.

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

The most common form of a warning sign has a sign board mounted on a post, with static information displayed on the sign board. The information conveys instructions, warnings, etc. to any person passing by. This type of sign is suitable for providing information of a general nature.

In certain circumstances, there is a need to provide a warning sign that has the capacity to vary the information to be conveyed. To this end, it is known to use illuminated signs that can vary a message by changing the illumination for the message. For example, road speed limit signs can be arranged to change the information displayed between two or more states, such as 80 km/h and 60 km/h.

It is also known to provide signs that contain a large amount of static information, and a variable component that can be manually changed to highlight the particular static information of interest in order to change the message to be conveyed to passers by. For example, it is known to convey a current fire danger rating on a sign that statically displays the range of possible ratings, and a manually movable pointer that is aligned to the current fire danger rating. The advantage of this type of sign is that a large amount of information is conveyed quickly: not only is the current fire danger rating conveyed, but also the level of the fire danger rating within the overall range of possible ratings. Fire danger rating signs with manually movable pointers are widely used across rural areas, particularly in and around towns, villages and major intersections where they are most likely to be seen by travelling persons.

However, a particular disadvantage of this type of sign is that the sign must be manually attended when a change is required. A change to the rating to be displayed can take a fire fighter/volunteer a large amount of time because of the time taken to travel between the signs. Accordingly, there is a need to provide a sign that can be quickly updated, whilst also providing the advantage of conveying a large amount of information quickly.

Accordingly, a problem currently exists where the likes of fire danger rating signs in remote locations are updated only by the physical presence of a person being required to update the sign status. Generally speaking, a similar drawback may be experienced by other environmental conditions signage such as, for example, signs for flood and snow conditions. With particular reference to the example of fire danger rating signage, noted above, existing signs for warning of fire conditions essentially consist of a manually operated sign with a wooden pointer which is rotated by a person on site to indicate one of a number of fire danger level as would be displayed on a face of the sign disposed towards the viewing public. The fire danger level in Australia had been traditionally categorised into "Low", "Moderate", "High", "Very High" and, "Extreme", ordinarily displayed as coloured segments over a semicircular display. Since the Victorian bushfires of February 2009, the National Bushfire Warnings Taskforce established a new fire danger rating system for bushfires, which now categorises conditions as "Low-Moderate", "High", "Very High", "Severe", "Extreme" and, "Catastrophic". The emphasis on the new rating system in light of the tragic loss of property and lives in 2009 has been to engender a more proactive response from the public by alerting the community to new forecast fire danger levels, and guide peoples' responses to forecast conditions, as well as when fires are burning.

It has been noted by the inventor that the existing signs can only be viewed in daylight as they are not illuminated and no meteorological or visual information is available at the point of the sign. They must each be physically changed to update the message. The information provided by existing signs provides basic information that may be incorrect as conditions change. In situations where fire occurs information needs to be updated quickly. Further, it may not always be possible to alter the signs during a fire event, particularly in remote communities. As a result some signs could potentially display incorrect information.

As existing signs are completely manual in their functionality, there is no ability to remotely operate existing fire danger rating signs and no ability to know what the sign is displaying without being at the sign.

Existing signs rely on highly visible reflecting material to be seen. Further, these signs cannot be interpreted unless a person needing to make use of the sign is close to sign.

SUMMARY OF INVENTION

It is an object of the embodiments described herein to overcome or alleviate at least one of the above noted drawbacks of related art systems or to at least provide a useful alternative to related art systems.

In one aspect of embodiments described herein the present invention provides an automated sign for indicating environmental conditions comprising a segmented conditions rating scale physically disposed on a substrate for public display wherein an illuminated display panel is operatively associated with each segment of the segmented conditions rating scale.

The illuminated display panels may be controlled to illuminate one and only one display panel at any one time in accordance with a received communications signal comprising prevailing environmental conditions.

The sign may further comprise a variable message display for conveying variable messages carried by the received communications signal.

In one embodiment the one or a combination of each of the illuminated display panels and each of the segments of the automated sign comprises a different colour and size increasing with corresponding levels associated with the conditions rating scale.

In another aspect of embodiments described herein the present invention provides a system for indicating environmental conditions comprising:

at least one sign as described herein; and a web server comprising processor means adapted to operate in accordance with a predetermined instruction set, said web server, in conjunction with said instruction set, being adapted to transceive communications signals comprising information corresponding to prevailing environmental conditions with the at least one sign via a modem located proximate the at least one sign.

In a preferred embodiment of the system the at least one sign comprises at least one sensor for collecting one or a combination of meteorological, visual and diagnostic information.

The web server is preferably adapted to collate information from a plurality of signs to provide an overall environmental status of a region for coordinating emergency services.

Furthermore, in preferred embodiments of the sign the illuminated display panels operatively associated with each segment are adapted to be visible and distinguishable from each other illuminated display panel at a distance of at least 2 kilometers by one or a combination of:

each illuminated display panel comprising at least one high intensity light emitting element;

the light emitting elements having distinguishable colours for each illuminated display panel; and the disposition of each illuminated display panel on the sign.

In yet another aspect of embodiments described herein the invention provides a warning sign for conveying status of a condition, the sign comprising: a plurality of sections that are permanently visible, each section representing a level of the condition; and a plurality of illuminated regions that are each associated with a respective section, each illuminated region having a light source, whereby, in use, the light sources are selectively illuminated such that the illuminated regions and sections together convey a selected status level of the condition.

In certain embodiments the sections comprise: a first section that represents a lowest level of condition severity, a second section that represents the highest level of condition severity, and one or more intermediate sections that each represent a distinct level of condition severity between the lowest and highest levels.

The illuminated regions may comprise a first illuminated region associated with the first section, and a second illuminated region associated with the second section, wherein the area of the first illuminated region is smaller than that of the second illuminated region.

Furthermore, the sections comprise one or a combination of colours, indicia, alphanumeric markings.

Preferably, the sections are arranged on the board in a manner that sequentially represents the possible levels of condition severity between lowest and highest levels.

In certain embodiments each of the intermediate sections has a corresponding intermediate illuminated region, wherein the area of each intermediate illuminated region is greater than the first illuminated region, and less than the second illuminated region.

The warning sign may further comprise an electronic control system for controlling illumination of the light sources.

The warning sign may further comprise a LED matrix adapted to be controlled by the control system to display a message and/or image.

The electronic control system preferably comprises a wireless device that is capable of receiving control information from a remote control at a remote location, such that the illuminated regions can be selectively set at the remote location.

The electronic control system may comprise at least one sensor that detects an observable condition, and the electronic control system is operated to automatically change the status condition conveyed by the sign based on a predetermined change in the condition detected by the sensor.

In certain embodiments, the observable condition is one or more of: temperature, wind speed and/or direction, humidity, barometric pressure, and water level.

In some alternative embodiments, the observable condition alternatively or additionally relates to speed and/or direction of a moving object.

Preferably the warning sign further comprises a battery for providing power to the light sources and electronic control system.

More preferably, the warning sign further comprises a solar panel and regulator for recharging the battery.

In still a further aspect of embodiments described herein the present invention provides a warning sign for conveying status of a condition, the sign comprising:

one or more light sources adapted for displaying a plurality of distinct status levels of the condition;

an electronic control system for controlling illumination of the light sources; and at least one sensor that detects an observable condition, wherein the electronic control system automatically changes the status condition displayed by the light sources in response to a predetermined change in the conditions detected by the sensor.

In yet another aspect of embodiments described herein the present invention provides a public warning system for conveying status of a condition at several discrete locations, the system comprising:

a plurality of signs as claimed in any one of claims 1 to 4 and 8 to 23, each sign having a wireless communication device and being located at one of the discrete locations;

a central control that remotely corresponds with the signs using a wireless network and the wireless communication devices of the signs, such that the signs can independently and/or collectively be directed by the central control to alter the status level of the condition.

Other aspects and preferred forms are disclosed in the specification and/or defined in the appended claims, forming a part of the description of the invention.

In essence, embodiments of the present invention stem from the realization that the combination of controllable illuminated light sources with permanently visible indicia within a sign for displaying environmental conditions will provide accuracy and immediacy of information dissemination that is commensurate with increasingly onerous public policy, legislation and technical standards for public safety.

This invention will allow better recognition of fire danger or other environmental hazard levels and through the collection of visual and meteorological data will provide a more coordinated approach to emergency services, such as for example, fire fighting and safety.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present invention may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

As noted above, conditions warning signs of the prior art may in the case of fire warning signs, use a moveable arrow to point to the corresponding danger rating as nominated by the relevant Fire Authority. Fire Authority operatives are required to manually attend the sign and manually move the pointer as well as manually change the type of message under the fire rating area, for example, to say "TOTAL FIRE BAN DAY".

Recognising the labour intensive effort and time taken to do this, the inventor recognises that an automated system controlled by one central point (preferably through the internet) would be of benefit, be more visual, save labour and also provide an operator feedback as to the sign status. Another feature would be the ability to display many different types of messages, as well as the current temperature, for example.

A preferred embodiment of the present invention pertaining to fire danger warning signs has many desired qualities such as:

1. The Use of LED's to display the current fire danger rating
2. The ability to flash the LED's
3. The ability to quickly flash the LED's when a CODE Red Rating occurs
4. A broadening band of LED displays from smaller (low-moderate rating) to larger (code red rating)
5. An LED display sign at the bottom of the sign to display user customised messages and the current temperature In accordance with such an embodiment the sign is preferably controlled by a Web based interface, enabling an authorised user to login to a website and change the condition of a sign or multiple signs automatically and virtually instantly. The sign is preferably equipped with a modem which has GPRS communication but other mobile communications platforms and protocols, as would be appreciated by the person skilled in the art, are envisaged. The sign is preferably powered by batteries, which are in turn charged via a solar panel. Through the Web based interface the operator will also be able to tell the status of each sign, e.g. what rating the sign is on, and this is something that cannot be done with the current static sign, without visual inspection.

Figure 1:
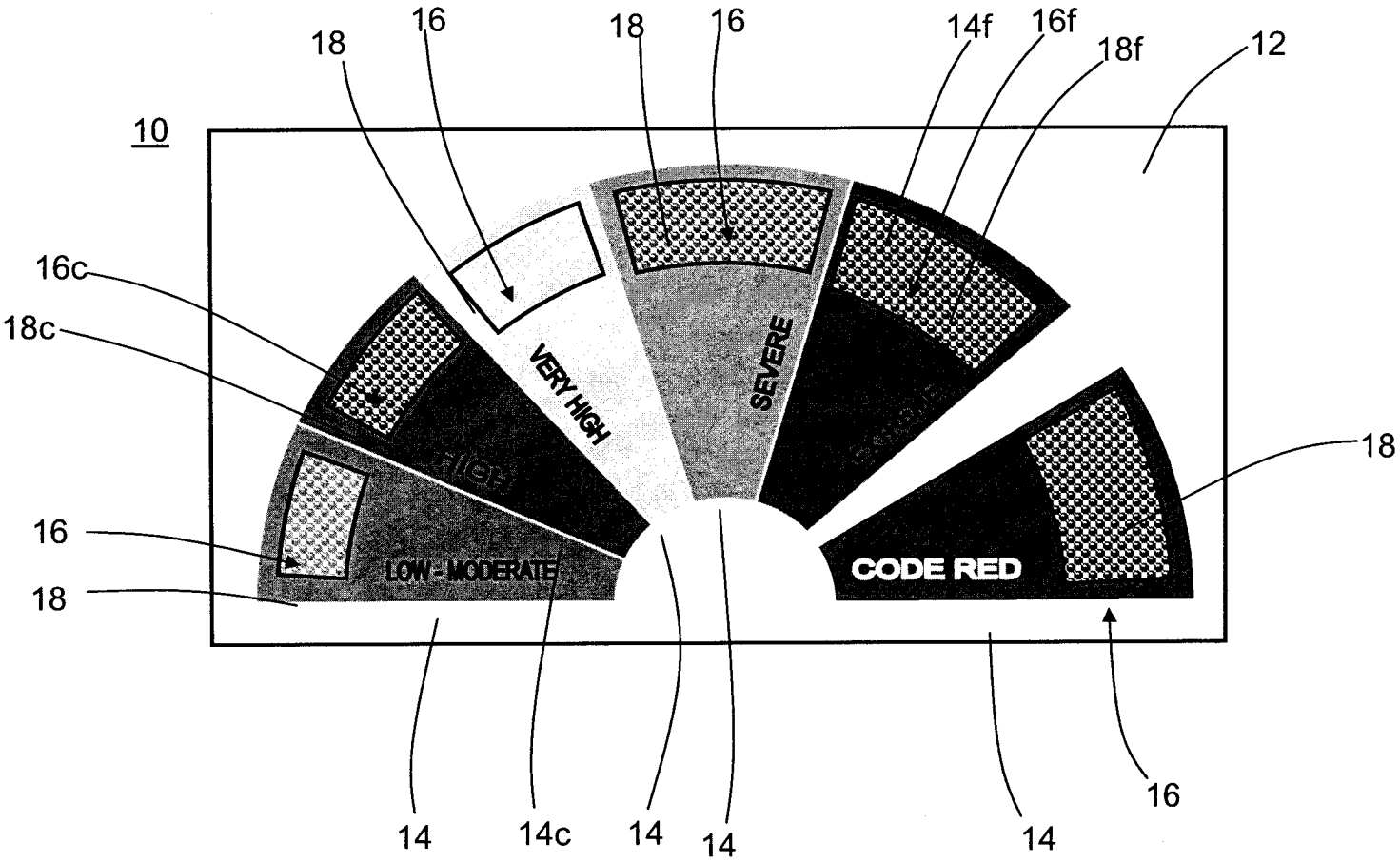
FIG. 1 is a schematic front view of a warning sign in accordance with a first embodiment of the present invention.
Figure 2:
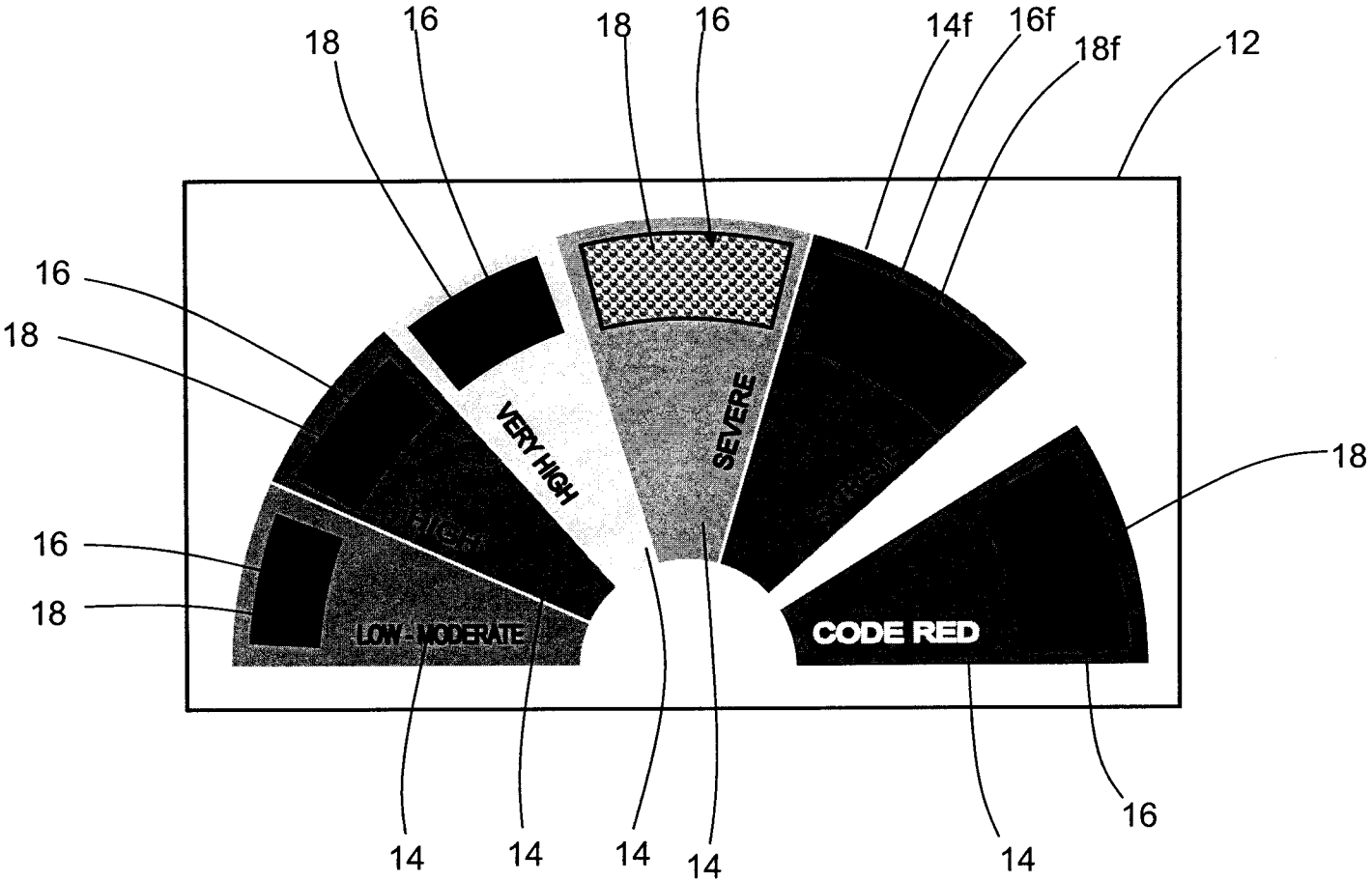
FIG. 2 is a schematic front view of the warning sign of FIG. 1, illustrating an operating condition.
Figure 3:
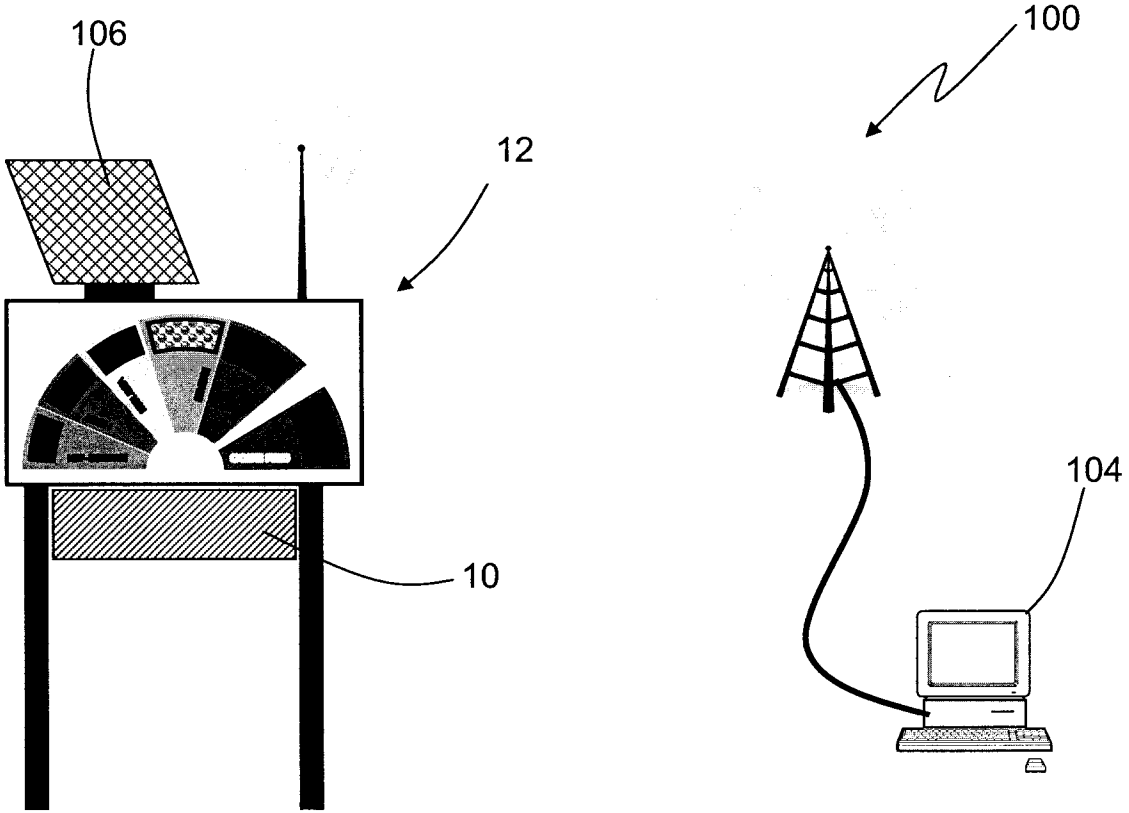
FIG. 3 is a schematic view of a public warning system according to a second embodiment of the present invention, which incorporates the warning sign of FIG. 1.

FIGS. 1 to 3 show a warning sign in accordance with a first embodiment of the present invention. In use, the warning sign conveys status of a condition. In this embodiment, the warning sign is in the form of a fire danger rating sign 10, and the condition is the fire danger rating. Thus, the sign 10 is arranged to convey a current fire danger rating.

The sign 10 has a plurality of sections that are permanently visible. Each section represents a level of the condition. In this embodiment, the board 12 displays six distinct fire danger ratings, and thus there are six sections. These include a first section 14*a*, which represents a "Low-Moderate" rating—the lowest of all the ratings that is to be conveyed by the sign 10; and a second section 14*b*, which represents a "Code Red" rating—the highest of all the ratings that is to be conveyed by the sign 10.

The sign 10 also has four intermediate sections 14*c*, 14*d*, 14*e*, 14*f* that respectively represent fire ratings "High", "Very High", "Severe", and "Extreme". The sections are hereinafter referred to collectively as "sections 14".

The sign 10 further has a plurality of illuminated regions 16*a*, 16*b* 16*c*, 16*d*, 16*e*, 16*f* (hereinafter referred to collectively as "illuminated regions 16"), that are each associated with a respective one of the sections 14. Each of the illuminated regions 16 has a respective light source 18*a*, 18*b* 18*c*, 18*d*, 18*e*, 18*f* (hereinafter referred to collectively as "light sources 18").

In use of the sign 10, the light sources 18 are selectively illuminated such that the illuminated regions 16 and sections 14 together convey a selected status level of the condition. Each of the sections 14 has the general shape of a circular arc segment, with sections 14 being arranged into an overall arc shape. The first and second sections 14*a*, 14*b* are positioned at either end of the arc, with the intermediate sections 14*c*, 14*d*, 14*d*, 14*f* positioned in between, in order of ascending fire danger rating severity.

In this embodiment, each of the illuminated regions 16 is positioned wholly within its respective section 14 but other configurations may be implemented as would be appreciated by the person skilled in the art.

FIG. 2 illustrates the sign 10 conveying a current fire danger rating of "Severe". The light source 18*e* of the illuminated region 16*e*, which is associated with the section 14*e* that indicates "Severe", is illuminated. The remaining light sources 18*a*, 18*b*, 18*c*, 18*d*, 18*f* are switched off. Accordingly, the sign 10 quickly conveys to a person passing by that the current fire danger rating is "Severe", and the relative position of this rating within the overall range of possible ratings.

In certain embodiments, each section 14 is coloured and/or patterned to be visually distinct from the other sections 14. In such embodiments, the light within the illuminated regions 16 can be coloured to match the respective section 14. For example, in the embodiment of FIGS. 1 and 2, the section 14*e* is coloured yellow, and the light source 18*e* emits yellow light. In some alternative embodiments, the illuminated region may include a filter to allow light of a desired colour to pass through to viewers of the sign.

Alternatively or additionally, the light source 18 may be flashed or strobed to provide a further indication of the fire danger rating being conveyed by the sign 10. For example, for a "Code Red", the light source 18*b* can flash at a desired rate and/or sequence.

In this embodiment, the light sources 18 are each an array of light emitting diodes (LEDs). These have the advantage of low power, being highly visible, and being easily coloured. Alternate light sources are envisaged such as for example light sources that utilise electroluminescence. Other forms of light source as would be understood by the person skilled in the art to be suitable for the present invention are envisaged for embodiments of the present invention.

As can be seen from FIGS. 1 and 2, the first illuminated region 16*a* is smaller in area than the second illuminated region 16*b*.

The area of each of illuminated regions 16*c*, 16*d*, 16*e*, 16*f* that are associated with the intermediate sections 14*c*, 14*d*, 14*e*, 14*f* is greater than that of the first illuminated region 16*a*, and less than that of the second illuminated region 16*b*. Furthermore, the area of each of the illuminated regions 16 is between that of its immediately adjacent illuminated regions 16. The LED array providing the light source 18 is sized according to the area of its respective illuminated region 16. This has the advantage that the lowest fire danger rating "Low-Moderate" consumes the least amount of power, and also that the fire danger rating "Code Red" provides the most powerful illumination with greatest visibility.

In the embodiment illustrated in FIGS. 1 and 2, each illuminated region 16 has the general shape of an arc segment. The angle subtended by each region 16 increases with increasing fire danger rating of the respective section 14. Alternatively or additionally, the radial width of each region 16 increases with increasing fire danger rating of the respective section 14.

The sign 10 includes an electronic control system (not shown in FIGS. 1 to 5 but discussed further below) that controls operation of the light sources 18 to enable selective display of a current fire danger rating. Thus, the electronic control system controls illumination of the light sources 18. The electronic control system can be operated to cause the light sources 18 to flash. The electronic control system can also adjust the flashing rate and/or sequence if desired.

The electronic control system can include at least one sensor that detects an observable condition, and the electronic control system can be operated to automatically change the status condition conveyed by the sign based on predetermined change in the condition by the sensor.

For example, the sign 10 may have temperature, wind speed and direction, humidity, and barometric pressure sensors. In the case of changes in certain measured observable conditions that match predetermined conditions, the sign 10 can automatically change the displayed fire danger rating. For example, a predetermined condition may include rapidly increasing temperature and wind speed with low humidity levels. Observation of matching conditions would then cause the sign 10 to automatically upgrade the displayed fire rating.

FIG. 3 is schematic illustration of a public warning system 100 according to a second embodiment of the present invention. The public warning system 100 includes the warning sign 10 of FIGS. 1 and 2. As will be appreciated, the warning sign 10 may be one of many such signs 10.

Each sign 10 of the public warning system 100 includes a wireless device, which may conveniently be housed in a sealed container 102. The wireless device is capable of receiving control information from a remote control at a remote location, such that the illuminated regions 16 of the sign 10 can be selectively set at the remote location. For example, the wireless device may be in the form of a modem and GPRS module, which enables the sign 10 to be controlled via a computer 104 that is connected to the internet.

This enables an operator at the computer 104 to communicate with each sign 10, and alter the current fire danger rating that is displayed. Further, the operator can almost instantaneously alter the current fire danger rating that is displayed by many signs 10. This has the distinct advantage that all the signs 10 within a fire region can be simultaneously updated by a single person. Accordingly, a procedure that has previously taken a large number of people, and consumed a large amount of time can be completed rapidly and reliably.

The computer 104 can be used to interrogate the sign 10 and check its current status displayed, as well as any observations obtained by its sensors. The public warning system 100 may be set up so that each sign 10 checks in to the computer 104 at a designated frequency. Thus, failure for a sign 10 to check in can indicate a possible fault.

In embodiments in which each sign 10 has the capacity to automatically change its status, the sign 10 can also be set up to advise the computer 104 of that fact. The change can be validated and/or propagated to other signs 10 within the system 100.

As indicated in FIG. 3, each sign 10 can be equipped with a solar panel 106, and a battery and regulator, contained within the container 102. Thus, the sign 10 can be self sufficient. Having the area of the illuminated regions 16 increase with increasing severity of fire danger rating has the advantage that when the fire danger rating is lowest, the corresponding light source 18*a* consumes the least power. As will be appreciated, this rating corresponds with most common fire danger rating throughout the year.

Figure 4:
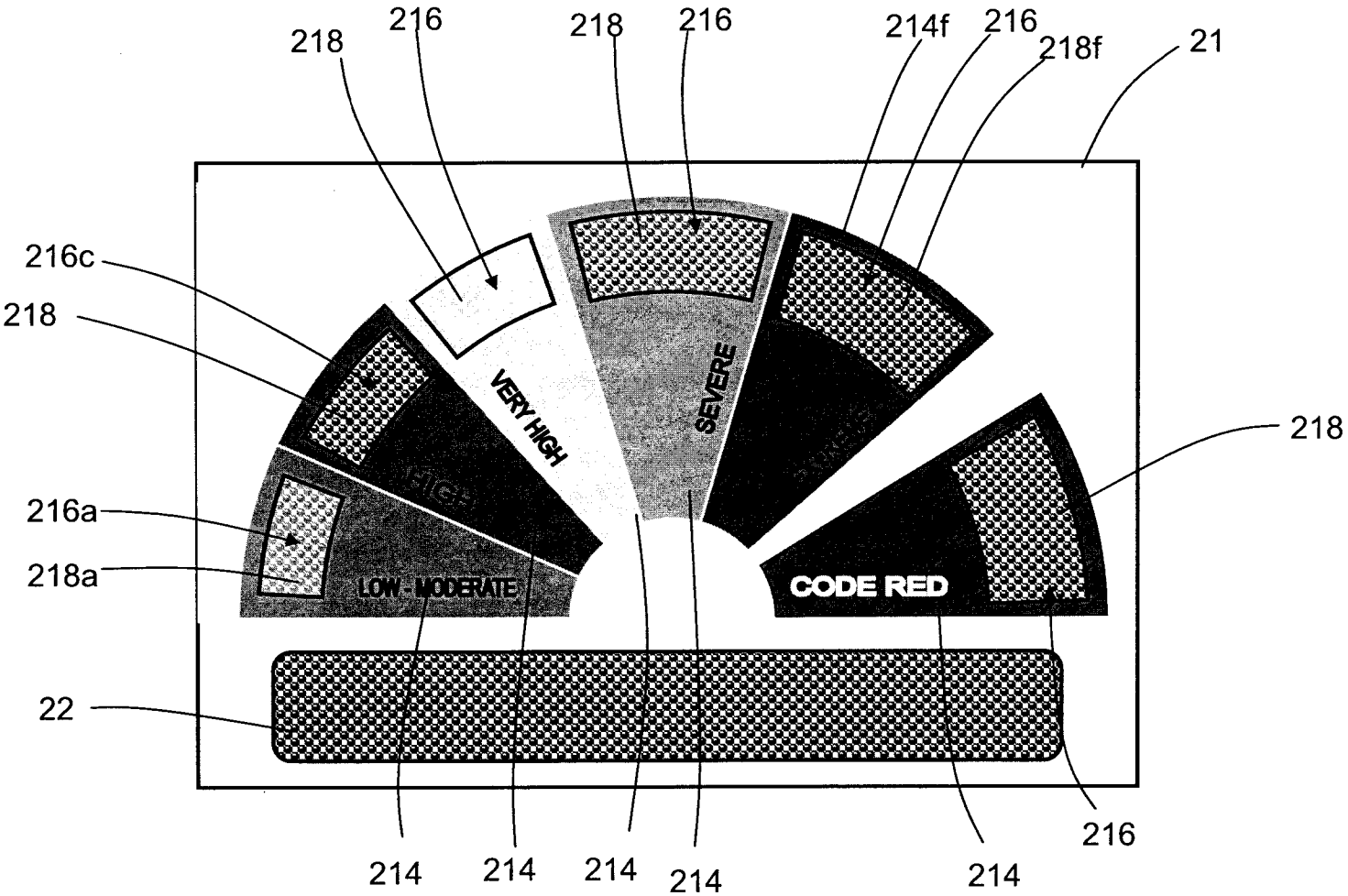
FIG. 4 is a schematic front view of a warning sign in accordance with a third embodiment of the present invention.
Figure 5:
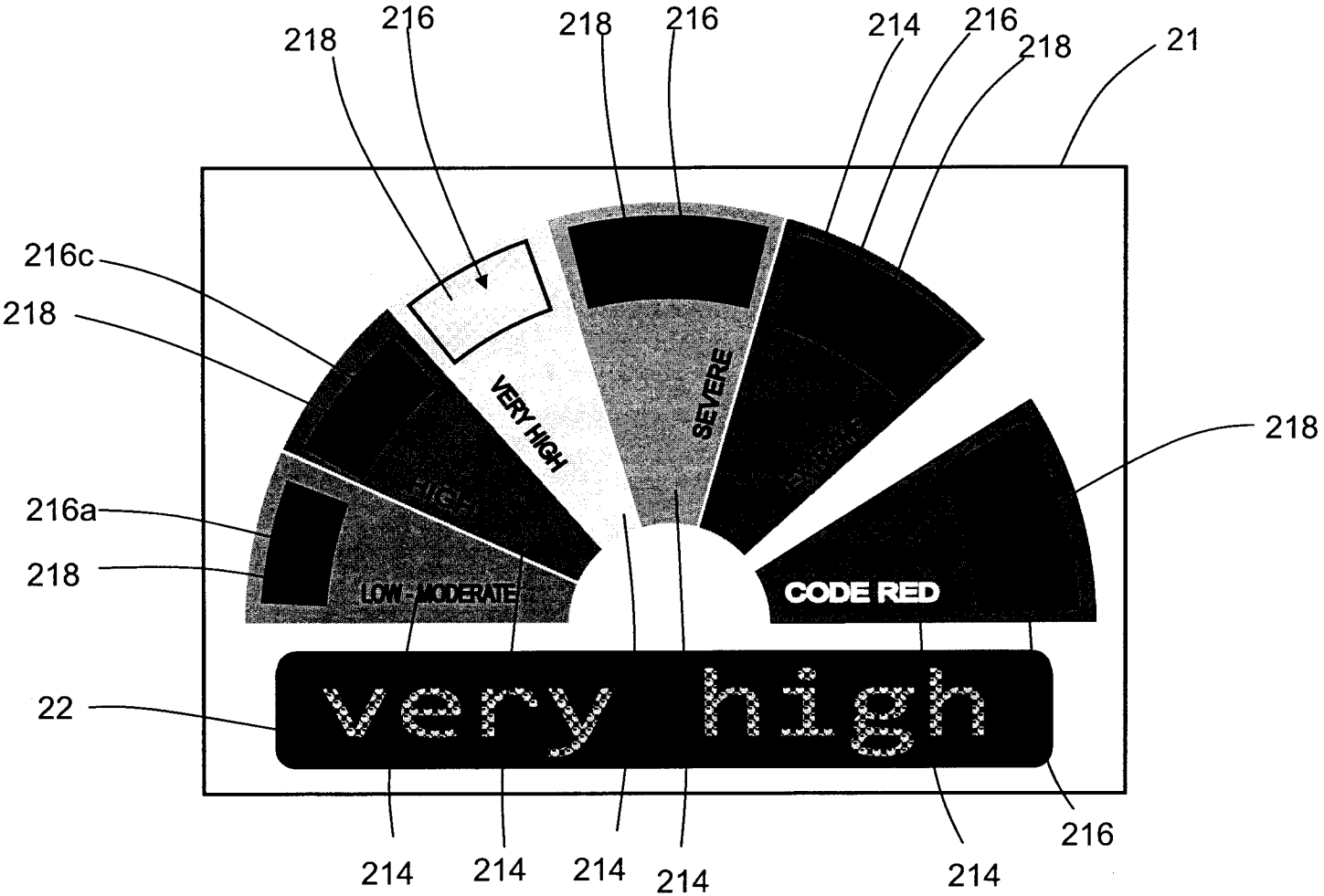
FIG. 5 is a schematic front view of the warning sign of FIG. 4, illustrating an operating condition.

FIGS. 4 and 5 show a sign 210 according to a third embodiment of the present invention. Features of the sign 210 that are the same or similar to those of the sign 10 have the same reference numerals with the prefix "2".

The sign 210 includes a LED matrix 220 that can display a message and/or image. The LED matrix 220 is controlled by the electronic control system. Where the sign 210 is part of a public warning system 100, the computer 104 can provide information to be displayed on the LED matrix 220. For example, the LED matrix 220 may be configured to provide relevant information, such as road closures in the nearby region.

FIG. 5 illustrates the sign 210 conveying a current fire danger rating of "Very High". The light source 218*d* of the illuminated region 216*d*, which is associated with the section 214*d* that indicates "Very High", is illuminated. The remaining light sources 218*a*, 218*b*, 218*c*, 218*e*, 218*f* are switched off. Accordingly, the sign 210 quickly conveys to a person passing by that the current fire danger rating is "Very High", and the relative position of this rating within the overall range of possible ratings.

Additionally, the LED matrix 220 displays the words "very high", which match with the current status. The LED matrix 220 can be multi-coloured so that the messages can be displayed in selected colours.

As will be appreciated, the above described embodiments are provided by way of example only. Modifications and/or alternative embodiments may be provided, without departing from the spirit and scope of the present invention.

For example, warning signs may be used for providing status level of a wide variety of conditions, such as flood severity, storm or cyclone warnings, UV index, terrorist threat level, the likelihood of snow storms or blizzards, the presence/likelihood of aggressive animal activity, and the like.

Further, warning signs may be used to provide traffic congestion status. In such embodiments, the signs may be provided with sensors that include radar detectors, ultrasonic detectors and/or Doppler lasers.

A preferred embodiment of the present invention relates to an automated fire danger rating sign which is primarily intended to provide clear visual information and warning relating to the risk associated with the immediate fire danger level in the locality of the sign.

As noted above in the preamble of the specification, in previous versions of fire danger rating signs, a wooden pointer is manually rotated to indicate the level of fire danger.

Figure 6:
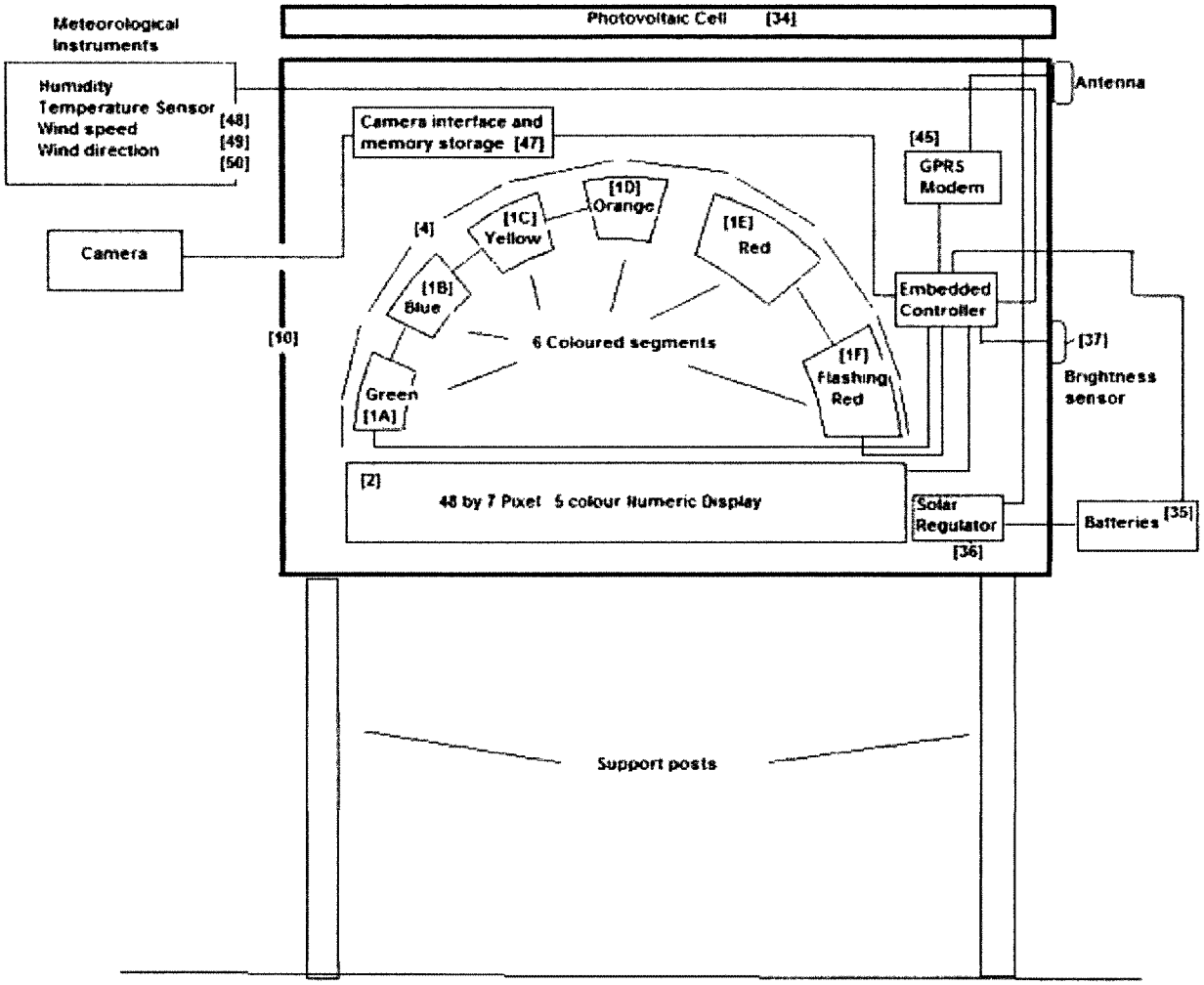
FIG. 6 is schematic diagram illustrating an automated sign displaying a fire danger rating and variable messages similar to that of FIGS. 4 and 5.
Figure 7:
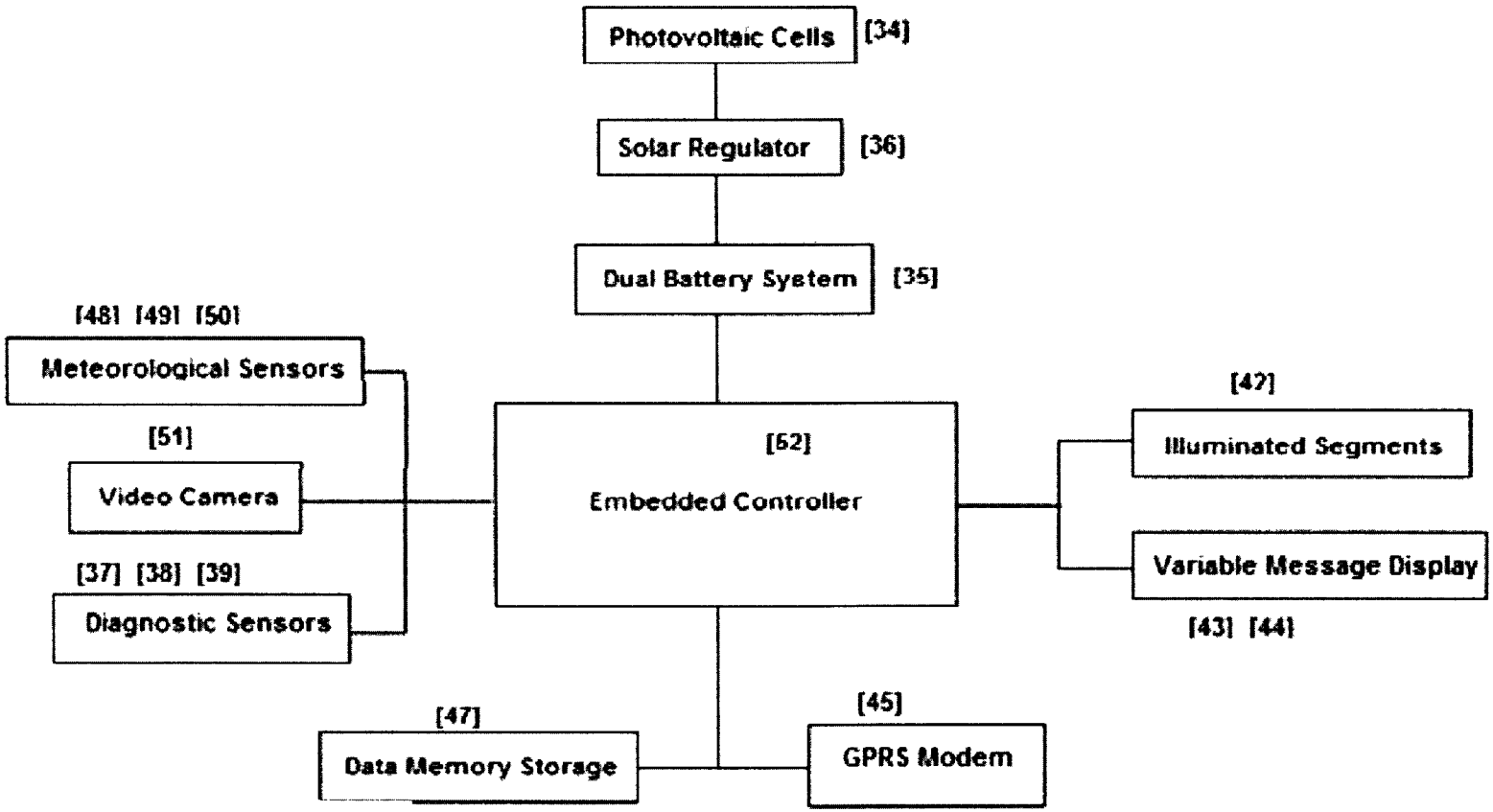
FIG. 7 is a block system diagram illustrating the components of a sign and their interworking in accordance with a preferred embodiment of the present invention.
Figure 8:
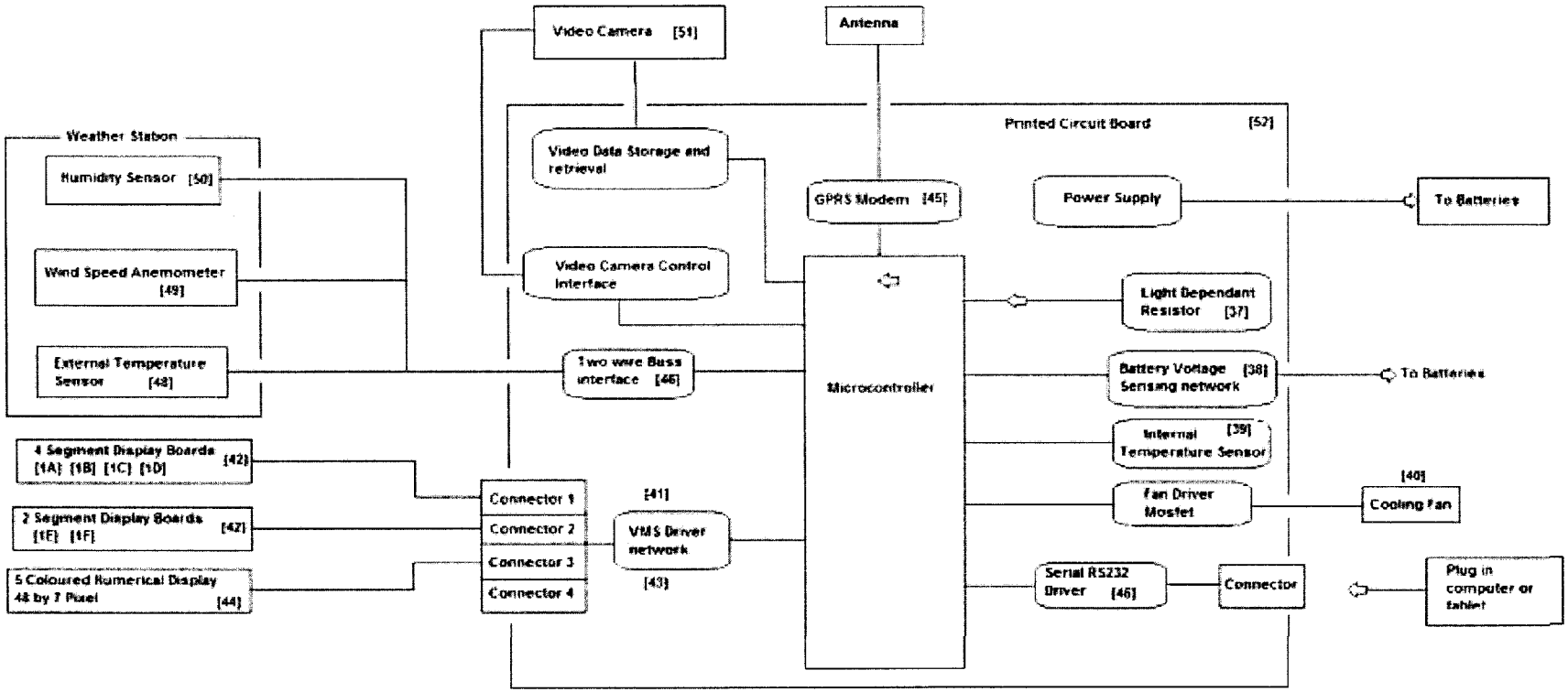
FIG. 8 is a block system diagram of a variable message display system adapted for monitoring and displaying conditions in accordance with a preferred embodiment of the present invention.

With reference to FIG. 6 a portable display sign 10 is shown in schematic diagram form and which comprises a segmented display 4 of a fire danger rating scale 1*a* to 1*f* and a variable message board portion 2. In this design a series of six (6) illuminated segments 1*a*, 1*b*, 1*c*, 1*d*, 1*e* & 1*f*, each with a different colour and size increasing with corresponding danger levels, are used to display the fire danger rating by virtue of their location on the perimeter of a semicircle, their size and by their colour. Preferably, only one segment 1*a*-1*f* can be illuminated at any time. The colours associated with each level of danger are:

| Danger Level | Colour |
|---|---|
| Low Moderate | Green (1a) |
| High | Blue (1b) |
| Very High | Yellow (1c) |
| Severe | Amber (1d) |
| Extreme | Red (1e) |
| Code Red | Red Flashing (1f) |

As noted, the sign 10 also has a rectangular variable message display 2 which may be used to provide additional alphanumeric or graphic information as to the fire danger or instructions to its viewers.

The sign 10 may be illuminated on either the front face or both the front and rear faces of the sign.

The sign is remotely controlled and monitored for the purpose of providing and updating information as to the fire danger level in a particular locality. The invention allows networking of information from multiple signs to be collected on a web based application for the purpose of gaining a bigger picture view of fire danger. This can be useful in coordinating fire fighting efforts.

With reference to FIGS. 6 to 10, the sign has an embedded microcontroller controller 52 with interconnections in the form of a radio modem with GPRS 45 which can connect via a telecommunications network to a website controlled by a third party. Communications via the mobile telephone network (refer FIG. 10) will allow all signs with a GPRS modem to be controlled and updated directly from a web server 53. The GPRS modem 45 sends and receives packets of data and communicates with a predetermined website. The website may be connected to a computer with a GPRS modem. The GPRS modem will be controlled by the computer but will communicate via transfer of small data packets with the sign via the remote GPRS modem. Access to the website is restricted by means of password and data is encrypted to ensure that unauthorised data requests and commands are ignored. Meteorological data collected 54 at the fire danger rating sign by a weather station 48, 49, 50 connected to the microcontroller will allow an operator to make decisions as to the status of fire danger in a particular region. Compilation of data from many signs will allow a trend with respect to fire danger to be calculated at a command location. This will allow more accurate information to be relayed back to the sign in the form of a variable message 44 and illuminate the most appropriate segment 42.

FIG. 4 is a flowchart illustrating the order by which firmware components of the sign are controlled and output visual information.

FIG. 5 is a block diagram which shows the interrelationship between all the components in the fire danger rating system with respect to communications.

The GPRS modem is connected to the controller by way of a serial data connection with transmit and receive lines as well as common serial handshaking lines to provide flow of data. Additionally the microcontroller is connected to a weather station via a standard two wire interface. The meteorological data collected from the weather station will include temperature 48, humidity 50, wind speed and direction 49. Meteorological data collected from a number of signs can be collated and used to provide the overall weather conditions from a region in which multiple signs exist. This information may be transferred back by GPRS modem 45 to one or more of the signs and displayed in the numeric display section of the sign 44.

Embodiments of the invention provide an automatic illuminated warning sign with monitoring and remote control capability for the purpose of providing instant and simple recognition to the public, of the fire danger level at the locality of the sign whilst allowing collected on site data to be viewed remotely.

There are six levels of fire danger indicated by the illuminated segments. Low to medium is coloured green and placed on the bottom left of the arc of the segments. As each level gets higher the segment moves clockwise and gets larger as well as changing colour. The high danger rating colour is blue-green (Cyan) and it is the second segment in the arc. The third segment is very high and is coloured yellow. The fourth segment is coloured orange and indicates Severe fire danger. The 5th and 6th segments are both coloured red however the sixth segment flashes at a rate of approximately 1 hertz.

The 5th segment indicates severe fire danger rating and is exceeded only by the 6th which is the code red or "catastrophic" condition. Communication with the GPRS modem 45 back to the central web server will provide the local weather information and coupled with that of other nearby sites will allow the webserver 53 at the central location to update the status of the fire danger. Messages advising the public of protective actions can be set at the central location 53 and relayed to each sign.

The automated fire danger level sign is controlled by an embedded electronic device with communications capability and various sensor and illuminated coloured segments as well as a variable message display.

Figure 9:
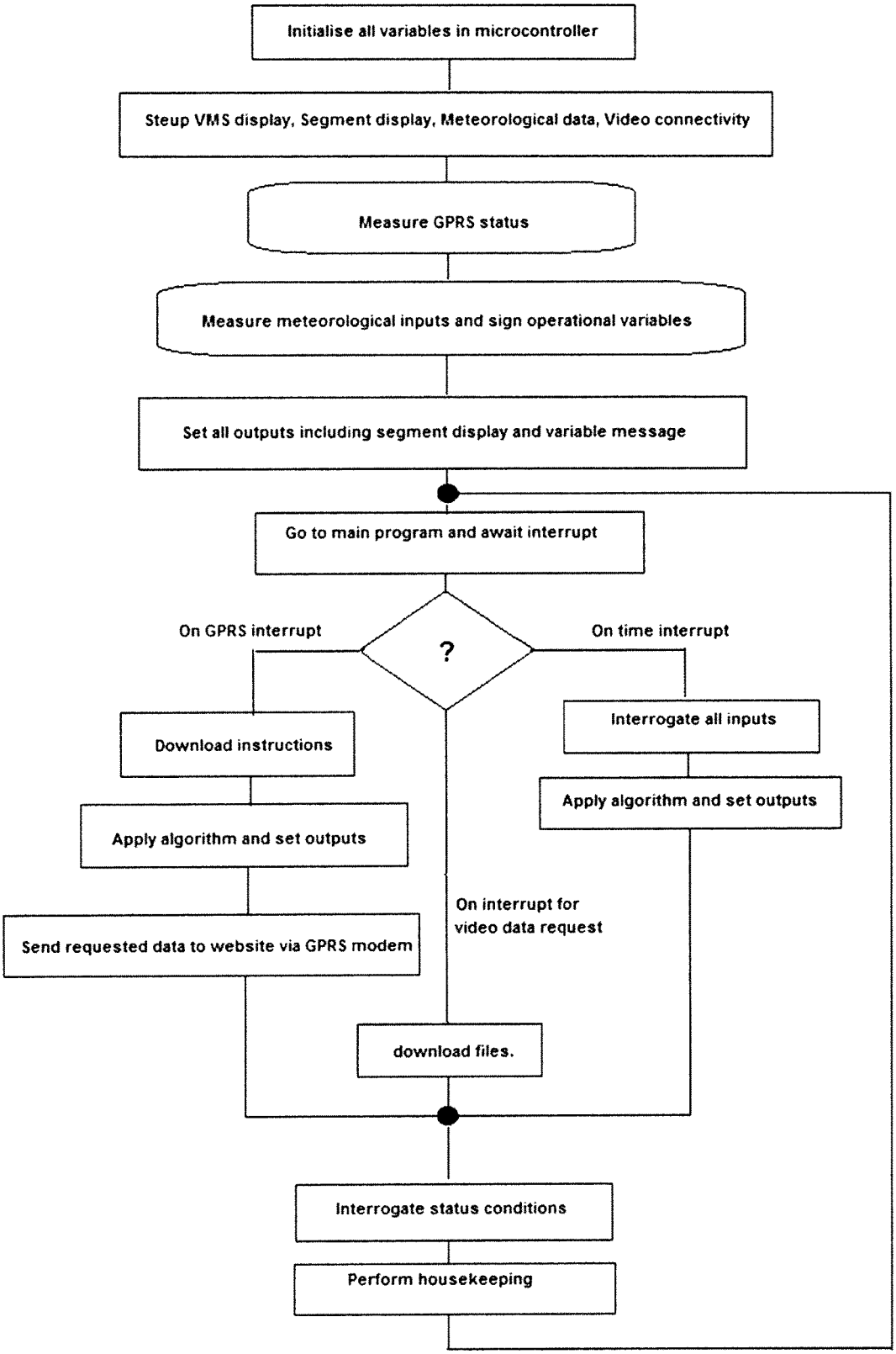
FIG. 9 is a flow chart illustrating the functions of a variable message display system of FIG. 8.

A microcontroller running a program senses the inputs from a weather station 54 the light intensity 37, battery voltage 38 and ambient temperature 49, wind speed 49, local humidity 50. It also inputs status such as internal temperature of the board 39, and process requests for input from the GPRS modem 45 video camera 51 and serial inputs 46. The microcontroller also acts on request from interrupts as shown in FIG. 9 and processes actions to download status information and update output requests. The output requests will include updating of the segment display 42 and the numerical display VMS 44. Light output intensity is regulated by an algorithm based on the ambient light levels provided by the light dependant resistor 37 but may be overridden from the central webserver 53.

The electronic system allows networking of information from many signs to be coordinated by a web based application collating information obtained from an onboard GPRS modem.

The new sign has a series of sensors which will allow meteorological, visual and diagnostic information to be remotely collected.

The sign has a set of commercial sensors which all connect to a two wire interface and are connected to the microcontroller. The two wire interface allows the microcontroller to request the output from each sensor individually and store its value. The sensors measure temperature 48, 39, humidity 50, wind speed and direction 49. Additional status sensors 37, 38, 39 allow the microcontroller to determine optimum operating conditions by using predetermined algorithms. Fine adjustment of all algorithms is possible by the serial interface 46 or by GPRS modem 45. The fire danger rating sign provides a summary of information collected to the general public in a form which quickly indicates the level of danger. This information is based on data collected from the sensors on a sign and collated with information collected from other signs in the region.

GPRS modem communications software and devices have been embedded in the sign controller in conjunction with the web based application at a central point. This allows regular two way communication between the sign and a web server. Remote signs can be updated immediately without need for a person to physically go to the sign. This is particularly advantageous in remote locations. These communications also allow coordination of information from many signs thus allowing a better picture of the overall fire status of a region. This will allow better direction of fire fighting services.

Figure 10:
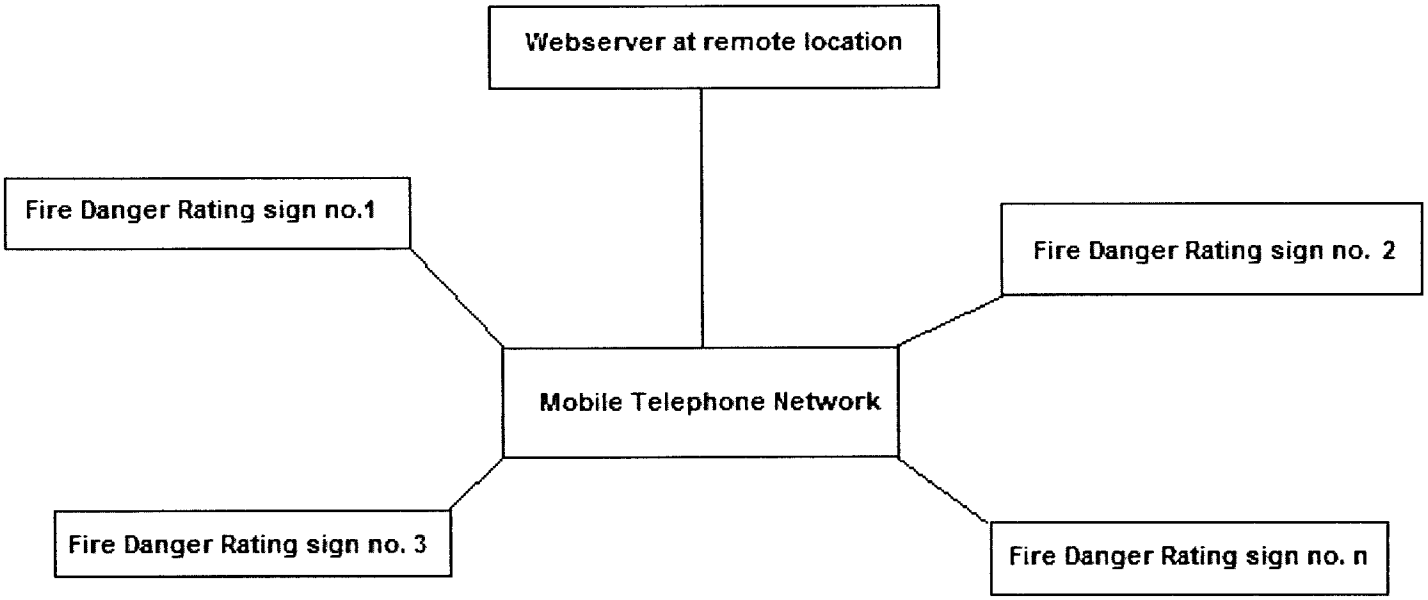
FIG. 10 is a simplified block system diagram of a variable message display system in accordance with the preferred embodiment of FIGS. 8 and 9.

As schematically depicted in FIG. 10, every sign is connected to a central webserver via the public mobile telephone network or an equivalent wide area network and/or wide area network in combination or internetworked with other smaller scale networks such as LAN's or campus networks. The sign has a GPRS modem which is continually active and sends and receives commands in the form of small packets of data. The data will be transmitted through various media which constitute a wider network, namely, the "world wide web". Each sign will have its own unique IP address and be addressable from any other IP location in the world subject to passwords and correct protocol. Data is continually monitored on site from each sign and uploaded to the central webserver 53.

At the webserver, all data from signs will be collated and a conclusion drawn as to the severity of the fire danger at each region by a human operator. The warning level and appropriate messages will be sent to each sign.

The illuminated segments and numerical display allow the sign to be seen from a greater distance and the message to be interpreted instantly. As the aim of the sign is to provide a danger level, the new sign allows instant recognition of the level even from a distance of about 2 kilometers by virtue of the colour of the segments, the position of the segments on the sign, the size of the illuminated segments and the information displayed on the variable message display.

The invention has meteorological sensors in the form of a weather station and a camera with video output which can be remotely accessed via the GPRS modem. On board data storage will allow information to be collected after an event. Collection of data during a fire will increase the ability to fight the fire. Data storage will assist with analysis after an event.

Weather conditions will be logged and stored in memory on a regular basis. This data including video images will provide a snapshot of a period of time up to including and after a fire danger period.

During a high danger fire period the video camera can be controlled to evaluate weather conditions around the sign. In particular if a fire is burning near the sign, images of the fire can be downloaded in order to quickly evaluate its severity. The same applies to weather information where sudden changes in temperature, humidity and wind speed or direction will be evaluated in real time. It will be possible to monitor weather conditions in one second periods however there will be some limitation in the speed of video data uploads. The main use of the video camera will be to provide fixed useful image updates in real time but a video image stored in a fireproof container which may be retrieved after an event to allow for greater analysis of the conditions. This information may be used to assist in preventing future events. The video data may also provide data for litigation, post mortem and other legal activities.

Variations to certain embodiments of the invention include the ability of the controller to interface to other sensors or display types including an audio alarm output. In a preferred embodiment, the invention may only include a small number of meteorological measurements and video display but could be expanded to include many other functions. The illumination of the sign may be performed by a series of Light emitting diodes (LEDS) but is not restricted to that technology. Any number of light sources could perform the same functions particularly for the segments, for example, electroluminescent devices as mentioned above. A preferred embodiment comprises a sign for a fixed location but could be used in a portable application on a trailer.

The microcontroller is not restricted to monitoring temperature, humidity, wind speed and direction. Other real world variables such as acceleration, dew point, particular gas sensing, smoke, pressure, sound, light intensity and distance are able to be measured.

The microcontroller section of the sign may include additional sensors by way of the common two wire interface 46 and has many spare analogue and digital inputs to accommodate sensors. Although the primary function of this embodiment is to provide fire danger rating it can be used to provide an indication of the danger of many other variables such as icy roads, snow conditions, water flood levels, high wind speeds, excessive temperature and noise levels.

In a preferred embodiment the sign is contained within an enclosure with a layout which is compliant with an approved layout of that of the Victorian CFA. The sign may be fixed or portable. The sign wording, for example, may be necessarily formed to comply with road traffic standards, such as for example those of the Australian standards.

In a preferred embodiment, the sign may be powered by one or more photovoltaic cells 34 and the energy may be stored in two or more batteries 35. Control of the batteries to prevent overcharging is by way of a solar regulator 36. The sensors provide data from which an assessment of the fire danger rating can be made by way of evaluation of the sensor data applied to an algorithm in the microcontroller. In this respect, fire danger is related to the temperature and humidity 48, 50. The rate at which a fire can travel and hence its severity is related to the wind speed and direction 49 indicates where the danger may occur. A video image will be useful where a fire is present. In this application video use is limited by the bandwidth of the mobile telecommunications network and during an event it is expected that fixed images will provide the information to allow analysis of fire danger rating assuming that the fire is within range of the fire danger rating sign. A fire proof electronic memory storage device will allow a black box recorder to store video images of the period up to and after an event.

The main features or components of the circuitry of a preferred embodiment are noted in the following list:

- A photovoltaic cell to provide a portable energy supply
- A dual battery system to allow for continuity of supply
- A solar regulator
- A sensor for determining the brightness levels of the display
- A sensor for determining the battery voltage
- A sensor to monitor the controller temperature
- A controlled fan to assist in cooling the controller and electronic components
- An interface to six coloured segmented displays
- Six coloured Illuminated segment displays
- A VMS interface (Variable Message Sign)
- A variable message display consisting of a number of multi-coloured VMS panels
- An internal embedded GPRS modem (With GPS functionality)
- An interface to allow connection of an external modem or tablet or PC
- A data memory circuit to allow for storage of video images up to 6 months
- A sensor to measure ambient temperature
- A sensor to measure wind speed
- A sensor to measure humidity
- A video camera which may be steered by the controller
- An electronic printed circuit board with microcontroller and associated circuitry While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

It should be noted that where the terms "server", "secure server" or similar terms are used herein, a communication device is described that may be used in a communication system, unless the context otherwise requires, and should not be construed to limit the present invention to any particular communication device type. Thus, a communication device may include, without limitation, a bridge, router, bridge-router (router), switch, node, or other communication device, which may or may not be secure.

It should also be noted that where a flowchart is used herein to demonstrate various aspects of the invention, it should not be construed to limit the present invention to any particular logic flow or logic implementation. The described logic may be partitioned into different logic blocks (e.g., programs, modules, functions, or subroutines) without changing the overall results or otherwise departing from the true scope of the invention. Often, logic elements may be added, modified, omitted, performed in a different order, or implemented using different logic constructs (e.g., logic gates, looping primitives, conditional logic, and other logic constructs) without changing the overall results or otherwise departing from the true scope of the invention.

Various embodiments of the invention may be embodied in many different forms, including computer program logic for use with a processor (e.g., a microprocessor, microcontroller, digital signal processor, or general purpose computer and for that matter, any commercial processor may be used to implement the embodiments of the invention either as a single processor, serial or parallel set of processors in the system and, as such, examples of commercial processors include, but are not limited to Merced™, Pentium™, Pentium II™, Xeon™, Celeron™, Pentium Pro™, Efficeon™, Athlon™, AMD™ and the like), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an exemplary embodiment of the present invention, predominantly all of the communication between users and the server is implemented as a set of computer program instructions that is converted into a computer executable form, stored as such in a computer readable medium, and executed by a microprocessor under the control of an operating system.

Computer program logic implementing all or part of the functionality where described herein may be embodied in various forms, including a source code form, a computer executable form, and various intermediate forms (e.g., forms generated by an assembler, compiler, linker, or locator). Source code may include a series of computer program instructions implemented in any of various programming languages (e.g., an object code, an assembly language, or a high-level language such as Fortran, C, C++, JAVA, or HTML. Moreover, there are hundreds of available computer languages that may be used to implement embodiments of the invention, among the more common being Ada; Algol; APL; awk; Basic; C; C++; Conol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PL/I; Prolog; Python; Rexx; SAS; Scheme; sed; Simula; Smalltalk; Snobol; SQL; Visual Basic; Visual C++; Linux and XML.) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g, a RAM, ROM, PROM, EEPROM, or Flash-Programmable RAM), a magnetic memory device (e.g., a diskette or fixed disk), an optical memory device (e.g., a CD-ROM or DVD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies (e.g., Bluetooth), networking technologies, and inter-networking technologies. The computer program may be distributed in any form as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality where described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL). Hardware logic may also be incorporated into display screens for implementing embodiments of the invention and which may be segmented display screens, analogue display screens, digital display screens, CRTs, LED screens, Plasma screens, liquid crystal diode screen, and the like.

Programmable logic may be fixed either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM or DVD-ROM), or other memory device. The programmable logic may be fixed in a signal that is transmittable to a computer using any of various communication technologies, including, but in no way limited to, analog technologies, digital technologies, optical technologies, wireless technologies (e.g., Bluetooth), networking technologies, and internetworking technologies. The programmable logic may be distributed as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The claims defining the invention are as follows:

1. An automated sign for indicating environmental conditions comprising a segmented conditions rating scale physically disposed on a substrate for public display wherein an illuminated display panel is operatively associated with each segment of the segmented conditions rating scale whereby the illuminated display panels are controlled to illuminate one and only one display panel at any one time in accordance with a received communications signal comprising prevailing environmental conditions and each of the illuminated display panels are adapted to be visible and distinguishable from each other illuminated display panel by one or a combination of:

each illuminated display panel comprising an array of high intensity light emitting elements;

the light emitting elements having distinguishable colours for each illuminated display panel;

the disposition of each illuminated display panel of the sign.

2. The sign as claimed in claim 1 further comprising a variable message display for conveying variable messages carried by the received communications signal.

3. The sign as claimed in claim 1 wherein one or a combination of each of the illuminated display panels and each of the segments comprises a different colour and size increasing with corresponding levels associated with the conditions rating scale.

4. A system for indicating environmental conditions comprising:

at least one sign as claimed in claim 1;

a web server comprising processor means adapted to operate in accordance with a predetermined instruction set, said web server, in conjunction with said instruction set, being adapted to transceive communications signals comprising information corresponding to prevailing environmental conditions with the at least one sign via a modem located proximate the at least one sign.

5. The system as claimed in claim 4, wherein the at least one sign comprises at least one sensor for collecting one or a combination of meteorological, visual and diagnostic information.

6. The system as claimed in claim 5, wherein the web server is adapted to collate information from a plurality of signs to provide an overall environmental status of a region for coordinating emergency services.

7. The sign as claimed in claim 1, wherein the illuminated display panels operatively associated with each segment are adapted to be visible and distinguishable from each other illuminated display panel at a distance of at least 2 kilometers.

8. A public warning system for conveying status of a condition at several discrete locations, the system comprising:

a plurality of signs as claimed in claim 1, each sign having a wireless communication device and being located at one of the discrete locations;

a central control that remotely corresponds with the signs using a wireless network and the wireless communication devices of the signs, such that the signs can independently and/or collectively be directed by the central control to alter the status level of the condition.

9. A sign for conveying status of an environmental condition, the sign comprising:

a plurality of sections that are segmented and spaced with respect to each other and that are permanently visible, each segmented and spaced section representing a level of status of the environmental condition; and a plurality of illuminated regions that are each operatively associated with a respective section, each illuminated region having a light source, whereby, in use, the light sources are controlled, in accordance with a received communications signal comprising prevailing environmental conditions, to be selectively illuminated only one illuminated region at any one time such that the illuminated regions and sections together convey a selected status level of the environmental condition and where each illuminated region in operative association with its respective section is adapted to be visible and distinguishable from each other illuminated region in operative association with its respective section by one or a combination of:

each illuminated region comprising an array of high intensity light emitting elements;

the light emitting elements having distinguishable colours for each section;

the disposition of each illuminated region on the sign.

10. The sign as claimed in claim 9, wherein the sections comprise:

a first section that represents a lowest level of condition severity, a second section that represents the highest level of condition severity, and one or more intermediate sections that each represent a distinct level of condition severity between the lowest and highest levels.

11. The sign as claimed in claim 10, wherein, each of the intermediate sections has a corresponding intermediate illuminated region, wherein the area of each intermediate illuminated region is greater than the first illuminated region, and less than the second illuminated region.

12. The sign as claimed in claim 9, wherein the illuminated regions comprise:

a first illuminated region associated with the first section, and a second illuminated region associated with the second section, wherein the area of the first illuminated region is smaller than that of the second illuminated region.

13. The sign as claimed in claim 9, wherein the sections comprise one or a combination of:

colours, indicia, alphanumeric markings.

14. The sign as claimed in claim 9, wherein, the sections are arranged on the board in a manner that sequentially represents the possible levels of condition severity between lowest and highest levels.

15. The sign as claimed in claim 9 further comprising an electronic control system for controlling illumination of the light sources.

16. The sign as claimed in claim 15 further comprising a LED matrix adapted to be controlled by the control system to display a message and/or image.

17. The sign as claimed in claim 15, wherein the electronic control system comprises a wireless device that is capable of receiving control information from a remote control at a remote location, such that the illuminated regions can be selectively set at the remote location.

18. The sign as claimed in claim 15, wherein, the electronic control system comprises at least one sensor that detects an observable condition, and the electronic control system is operated to automatically change the status condition conveyed by the sign based on a predetermined change in the condition detected by the sensor.

19. The sign as claimed in claim 18, wherein the observable condition is one or more of: temperature, wind speed and/or direction, humidity, barometric pressure, and water level.

20. The sign as claimed in claim 18 wherein the observable condition alternatively or additionally relates to speed and/or direction of a moving object.

21. The sign as claimed in claim 9 further comprising a battery for providing power to the light sources and electronic control system.

22. The sign as claimed in claim 9 further comprising a solar panel and regulator for recharging the battery.

23. A warning sign for conveying status of an environmental condition, the sign comprising:

a plurality of light sources whereby each of the plurality of light sources is operatively associated with one of a plurality of segments of a segmented condition rating scale physically disposed on a substrate for public display wherein in combination the light sources and their operatively associated segments are adapted for displaying a plurality of distinct status levels of the environmental condition;

an electronic control system for controlling illumination of the light sources; and at least one sensor that detects an observable environmental condition, and which is in communication with the electronic control system;

wherein the electronic control system automatically changes the status condition displayed by the light sources in response to a predetermined change in the environmental condition detected by the sensor and each of the plurality of segments are adapted to be visible and distinguishable from each other by one or a combination of:

each of the plurality of light sources comprising an array of high intensity light emitting elements;

the light emitting elements having distinguishable colours for each respective segment;

the disposition of each segment on the sign.

* * * * *